United States Patent [19]

Reed

[11] 4,073,385

[45] Feb. 14, 1978

[54] CAR COUPLER

[75] Inventor: Robert T. Reed, Moorestown, N.J.

[73] Assignee: Walton Products, Inc., Broomall, Pa.

[21] Appl. No.: 758,944

[22] Filed: Jan. 13, 1977

[51] Int. Cl.[2] ..... B61G 3/04

[52] U.S. Cl. ..... 213/100 R; 213/104

[58] Field of Search ..... 213/100 R, 100 W, 104, 213/105, 108, 109, 109 T, 109 L

[56] References Cited

U.S. PATENT DOCUMENTS

| | | | |
|---|---|---|---|
| 372,350 | 11/1887 | Wilson | 213/105 |
| 3,899,084 | 8/1975 | Gobrecht et al. | 213/100 R |

*Primary Examiner*—Trygve M. Blix
*Assistant Examiner*—Sherman D. Basinger
*Attorney, Agent, or Firm*—Zachary T. Wobensmith, 2nd; Zachary T. Wobensmith, III

[57] ABSTRACT

An automatic coupler for railway and other vehicles which includes an outer housing carried by the vehicle and formed of a plurality of welded metal plates, with a spring urged coupler hook mounted therein for horizontal pivotal movement for engagement with the hook of a coupler mounted on an adjacent vehicle. The coupler hook on the adjacent vehicle is urged into engagement position and retained therein by a keeper arm which is engaged with the coupler hook on the first vehicle for movement therewith. The coupler hook is unlocked by a cam bearing on it and which may also act on the opposed interengaged coupler hook from the adjacent vehicle, which cam may be operated manually or automatically.

6 Claims, 4 Drawing Figures

CAR COUPLER

BACKGROUND OF THE INVENTION

1. Field of the Invention

This invention relates to an automatic car coupler of the type which includes a housing of welded metal plates carried on a car to be coupled, the housing carrying a hook therein which is actuated by a cam, and carries a keeper arm to urge the hook from the car to be coupled to into engagement and provides continued retention of the hook engagement.

2. Description of the Prior Art

Automatic car couplers for use on a railway vehicles are in common use on subway cars and other railway vehicles. Many of the couplings in use rely on an outer housing that is formed as a casting and then machined. Such housings are subject to failure due to inclusions, are very heavy and are quite costly to manufacture. The structure must be durable and positive in operation as well as simple, safe and easy to operate and service. Examples of such couplers are shown in the patents to Cope, U.S. Pat. Nos. 3,181,708 and 3,405,811 and to Metzger, U.S. Pat. No. 3,693,809.

Cope in U.S. Pat. No. 3,181,708 shows structure for restricting the movement of a hook with a broken spring but this is effected by interlocking the hook with the uncoupling cam and thus differs in essential respects from the present invention.

In prior U.S. Pat. No. 3,899,084, there is shown an automatic car coupler which utilizes a welded outer housing and a simple hook structure with a double acting cam for hook disengagement. The hook is spring urged into a central engaged position. Problems occur if the spring urging the hook into engagement position becomes broken before coupling or after coupling. The hook can then move away from an engaged position and not couple or it can become uncoupled while in operation so that the cars can move apart.

The keeper of my invention urges a hook with broken spring into engagement position and retains it there as desired.

SUMMARY OF THE INVENTION

This invention relates to a car coupler which includes a housing carried by a railway vehicle and preferably fabricated of welded metal plates, which contains a spring biased coupler hook for engagement with an opposed coupler hook carried on an adjacent car with automatic or manual cam action on the hooks for unlocking and with a keeper arm operated by and engageable with the hooks to urge the hooks into engaged positon and providing retention therein.

The prinicpal object of the invention is to provide a car coupler wherein the hook is retained in engaged position whether or not its spring is operating or broken.

A further object of the invention is to provide a car coupler which includes a keeper arm to urge a coupler hook with a broken spring into engagement with another coupler hook.

A further object of the invention is to provide a car coupler which has improved operation and a long service life.

A further object of the invention is to provide a car coupler that is sturdy and safe.

A further object of the invention is to provide a car coupler that is positive in operation.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
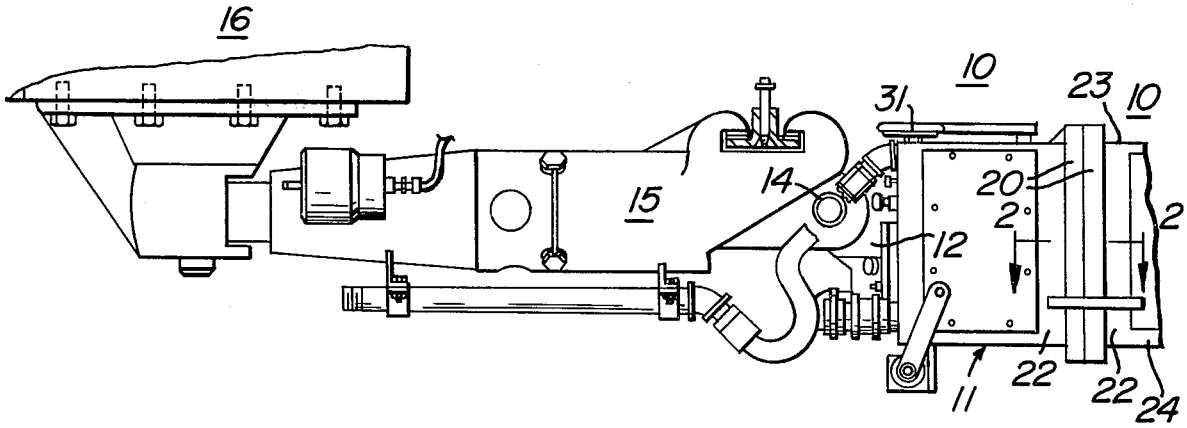
FIG. 1 is a side elevational view of the car coupler in accordance with the invention.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings, the car coupler 10 includes an outer housing 11 which is composed of a plurality of metal plates preferably welded together. The housing 11 of generally rectangular configuration, has an integral swivel joint 12 at the rear thereof which is adapted to receive a horizontal shank pin 14 for connection to a yoke 15 on a railway vehicle 16 as shown in U.S. Pat. No. 3,899.084. The housing 11 includes a front plate 20, side plates 22, top plate 23, and bottom plate 24 in angular relation and secured to each other and to the swivel joint 12 and to the front plate 20 by welding. The plate 20, side plates 22, top plate 23 and bottom plate 24 define a cavity 26.

The front plate 20 is provided with cooperating centering pins (not shown) which project forwardly of the plate and are received in sockets (not shown) in an opposed plate 20.

The front plate 20 is provided with a rectangular opening 27 therein for access to the cavity 26 and may have angularly oriented guide surfaces thereon (not shown).

Within the cavity 26, a coupler hook 30 is pivotally mounted for horizontal movement by a pivot pin 31 extending through and carried by bearings (not shown) in the top and bottom plates 23 and 24. The coupler hook 30 is of conventional shape for connection to like coupler hooks and includes a shank 35 with a head 36 thereon which extends beyond the front plate 20 and at the rear extends inwardly to provide a flat pulling face 37. The head 36 has a rounded nose 38 which tapers forwardly along meeting faces 40 and 41. Face 41 is a contact face and in operation engages and slides along a similar face 41 on a hook 30 on a coupler carried by an adjacent car (not shown) to be engaged.

The coupler hook 30 is urged on its pivot pin 31 inwardly toward the center of the cavity 26 and opening in plate 20 (not shown) for coupling by a leaf spring 43 engaged with a vertical pin 44 on an extension 45 of the coupler hook 30. The spring 43 is carried on a vertical pin 46 mounted in bottom wall 24 and bears on side wall 22.

The coupler hook 30, along the shank 35 rearwardly of head 36 and intersecting face 37, has a face 50 which is engaged by the face 51 of a hook separating cam 52 when the hook is in centered coupling position. The cam 52 is illustrated as a double face cam of general triangular shape with a rounded toe 53 and a rounded heel 54 which can engage the face 50 of the coupler hook 30 for unlocking. The toe 53 of cam 52 engages the face 41 of the head 36 of the coupler hook 30 from another coupling in an adjacent car (not shown) for uncoupling of the hooks 30.

The cam 52 is pivotedly mounted by pin 60 to and between the top and bottom plates 23 and 24. The cam 52, adjacent to its heel 54, has a rounded nose 61 which is engaged by a pawl 62 for actuation of the cam 52, which pawl 62 is mounted on a shaft 63. The shaft 63 extends upwardly through the bottom and top plates 24 and 23 and may be driven by a pneumatic actuator or actuated manually as desired.

The coupler hook 30, on its shank 35, is provided with a boss 70 which has a slot 71 therein. A pin 72 of a keeper arm 75 is engaged therewith and is free to move in the slot 71. The keeper arm 75 is pivotally mounted by a shaft 76 engaged in bottom plate 24 and in top plate 23. The keeper arm 75, of generally rectangular shape, has a cam face 80 which can engage the face 40 of an adjacent coupler hook 30 in a manner to be described.

The mode of operation will now be pointed out.

Figure 2:
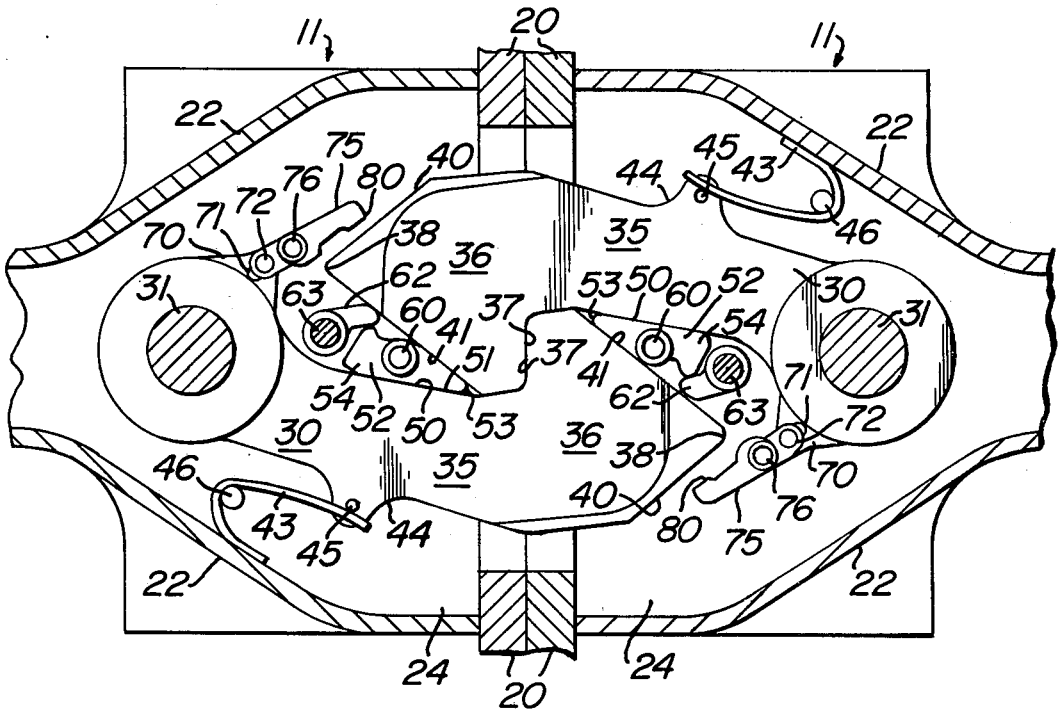
FIG. 2 is a horizontal transverse sectional view taken approximately on the line 2—2 of FIG. 1 illustrating two coupler hooks in engaged positon.
Figure 3:
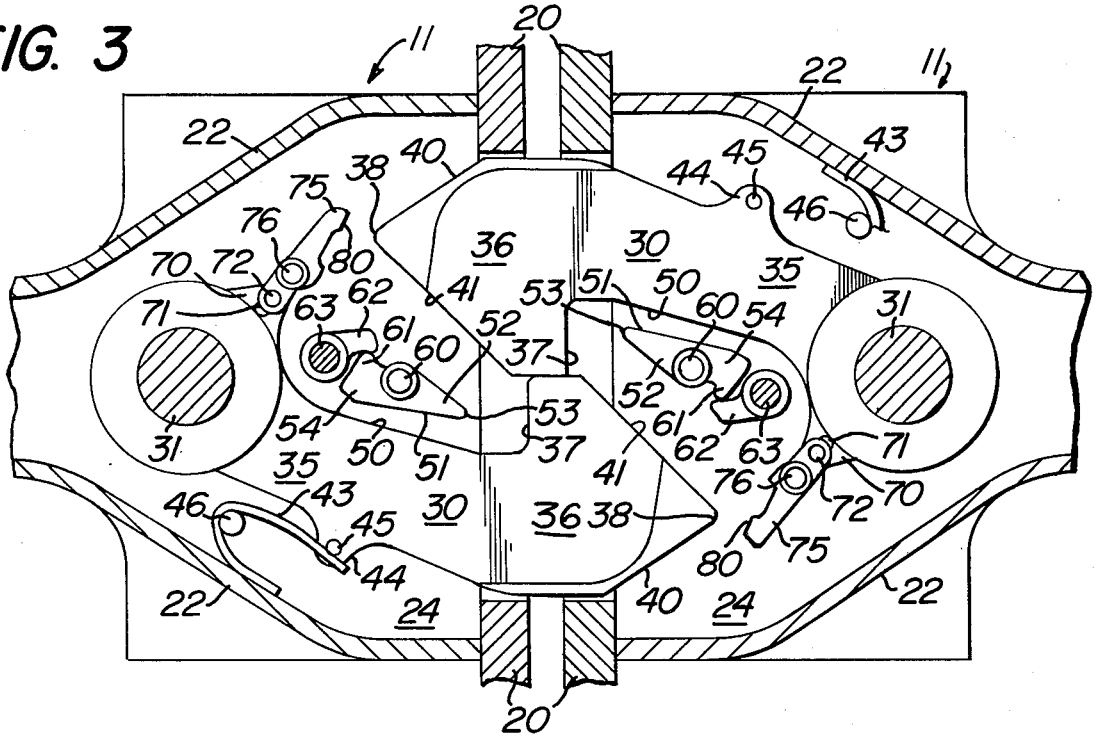
FIG. 3 is a view similar to FIG. 2 illustrating the coupler hooks in open or disengaged position.
Figure 4:
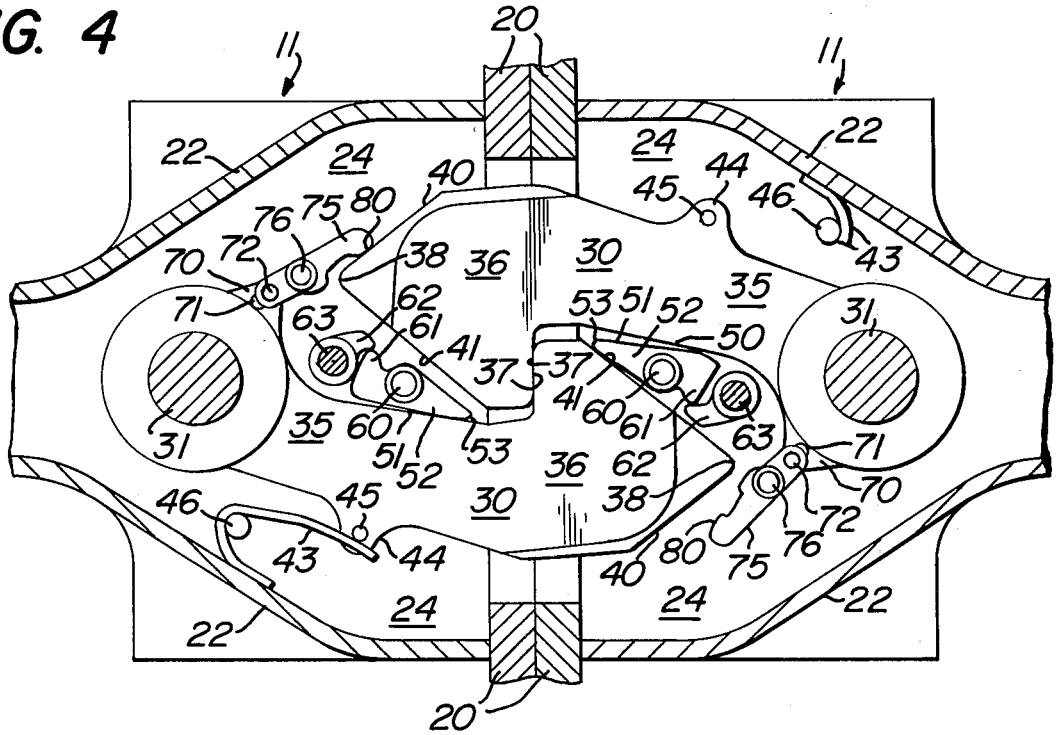
FIG. 4 is a view similar to FIG. 2 illustrating coupler hooks where one spring is broken and the coupler hook is retained in engaged position by a keeper arm.

Referring to FIGS. 3, and 4 of the drawings, the hooks 30 are shown in the open position and sliding past one another to reach the position shown in FIG. 2 where the coupler hooks 30 are in fully engaged coupled position. In the open or uncoupled position, as shown in FIG. 3, the keeper arms 75 are out of the contact with the coupler hooks 30. When the coupler hooks 30 move toward the center of housing 11 and faces 37 are in line, then normally the coupler hooks 30 would be urged inwardly by the springs 43 until they were fully engaged as shown in FIG. 2

However, if a spring 43 is broken as shown in FIG. 3, and without the keeper arm 75 then one coupler hook 30 would not necessarily fully engage the other coupler hook 30 and if hooked would be subject to outward movement at any time. Upon rotation of coupler hook 30, with a broken spring 43 and with a keeper arm 75, the keeper arm 75 would be rotated about its shaft 76 by the movement of its pin 72 in slot 71. The face 80 would engage the face 40 of the coupler hook 30 with its broken spring 43 and urge the coupler hook 30 to coupled position as shown in FIG. 4 where it would be retained until the coupler hook 30 was again positively moved outwardly for uncoupling.

Upon rotation of cam 52 by pawl 62, the coupler hooks 30 are forced apart and keeper arm 75 is rotated about shaft 76 away from contact with face 40 of the coupler hook 30 so that the coupler hooks 30 uncouple. It should be noted that it will be apparent to an operator that if a spring 43 is broken the coupler hook 30 with broken spring will remain in an outward position when uncoupled.

The cars can be coupled and uncoupled automatically and manually with the cycles repeated as desired.

It will thus be seen that apparatus has been provided with which the objects of the invention are achieved.

I claim:

1. In apparatus for controlling the coupling and uncoupling of railway vehicles for each of the vehicles to be coupled including a housing at an end of the vehicle to be coupled to another vehicle, said housing having a resiliently biased coupler hook carried therein having a position for coupling engagement and an out of engagement position, said coupler hook having a vertically disposed pulling face and a vertically disposed control face, a cam carried in said housing engageable with said control face for moving said coupler hook to an out of engagement position, a pawl in engagement with said cam for actuating said cam, and means for moving said pawl for operating said cam, the improvement which comprises means engaged with a portion of said coupler hook and movable thereby into engagement with another coupler hook positively holding said last mentioned coupler hook in coupled engagement.

2. Apparatus as defined in claim 1 in which said last mentioned means comprises a slotted boss for positioning thereof.

3. Apparatus as defined in claim 1 in which said last mentioned means includes a keeper arm pivotally mounted by a shaft to said housing.

4. Apparatus as defined in claim 3 in which said keeper arm has a pin engaged in a slotted boss on said coupler hook for pivotal rotation of said keeper arm about said shaft upon rotation of said coupler hook.

5. Apparatus as defined in claim 4 in which said keeper arm has a cam face for engagement with a portion of said last mentioned coupler hook.

6. Apparatus as defined in claim 1 in which said last mentioned means urges one of said couplers into coupling engagement with the other of said couplers when one of said couplers is not resiliently biased.

* * * * *